US007081163B2

(12) United States Patent
Metzger et al.

(10) Patent No.: US 7,081,163 B2
(45) Date of Patent: Jul. 25, 2006

(54) EDGE-CONTROL SYSTEM FOR CURTAIN COATER

(75) Inventors: Rolf Metzger, Dietlikon (CH); Luca Frediani, Zürich (CH); Bruno Holtmann, Dielsdorf (CH); Hans Hardegger, Greifensee (CH)

(73) Assignee: Bachofen + Meier AG Maschinenfabrik, Bulach (CH)

( * ) Notice: Subject to any disclaimer, the term of this patent is extended or adjusted under 35 U.S.C. 154(b) by 70 days.

(21) Appl. No.: 10/474,790

(22) PCT Filed: Apr. 5, 2002

(86) PCT No.: PCT/EP02/03776

§ 371 (c)(1),
(2), (4) Date: Dec. 3, 2003

(87) PCT Pub. No.: WO02/081103

PCT Pub. Date: Oct. 17, 2002

(65) Prior Publication Data

US 2005/0126479 A1 Jun. 16, 2005

(30) Foreign Application Priority Data

Apr. 9, 2001 (DE) ..... 101 17 668

(51) Int. Cl.
*B05C 3/02* (2006.01)

(52) U.S. Cl. ..... 118/410; 118/325; 118/DIG. 4

(58) Field of Classification Search ..... 118/DIG. 4, 118/325, 419, 410; 427/420
See application file for complete search history.

(56) References Cited

U.S. PATENT DOCUMENTS 4,974,533 A * 12/1990 Ishizuka et al. ..... 118/411
6,048,582 A * 4/2000 Schweizer et al. ..... 427/420
6,464,858 B1 * 10/2002 Brown et al. ..... 118/410
6,468,592 B1 * 10/2002 Becker et al. ..... 427/420

* cited by examiner

*Primary Examiner*—Brenda A. Lamb
(74) *Attorney, Agent, or Firm*—Andrew Wilford

(57) ABSTRACT

A coating system for a web traveling in a web-travel direction has a slot nozzle from which a curtain of a coating material falls on the traveling web and a pair of guide elements flanking the slot nozzle and having confronting and vertical inner faces engaging and defining edges of the curtain. Respective aspiration elements fixed at lower ends of the guide elements have inner faces vertically aligned with and forming vertical continuations of the inner faces of the respective guide elements, and each formed with a vertical and inwardly open aspiration groove and with a transversely extending vacuum passage open into the respective groove. Respective floors on the aspiration elements downwardly close the respective aspiration grooves and are each formed with a sharp inwardly directed edge closely spacedly juxtaposed with the web. Excess coating material is aspirated from the curtain through the vacuum passages.

8 Claims, 2 Drawing Sheets

EDGE-CONTROL SYSTEM FOR CURTAIN COATER

CROSS REFERENCE TO RELATED APPLICATIONS

This application is the US national phase of PCT application PCT/EP02/03776, filed 5 Apr. 2002, published 17 Oct. 2002 as WO 02/081103, and claiming the priority of German patent application 10117668.6 itself filed 9 Apr. 2001.

FIELD OF THE INVENTION

The invention relates to an apparatus for coating a traveling material web with a slot nozzle emitting a free-falling curtain of coating material and having at each side of its outlet slot a downwardly extending guide element for an edge of the curtain, and with an element at each edge of the web for aspirating coating material.

BACKGROUND OF THE INVENTION

In order to coat traveling webs, such as paper or cardboard webs or plastic or metal foils, so-called curtain coaters are known that apply the coating material (plastic dispersions, inks, etc.) to the web as a free-falling curtain from a slot nozzle. In order to produce a stable curtain that is uniform over the entire coating width, WO 99/09253 (DE 197 35 558 and U.S. Pat. No. 6,468,592) describes guiding the two curtain edges each with a guide element extending from the slot nozzle down to near the web. The two guide elements are formed as bars and have flat inner faces turned toward the curtain. So as to hold the curtain in contact with the guide elements and thus prevent the curtain edges from moving inward, the inner face of each guide element are coated with a wetting agent, for example water or the coating material, that influences surface tension.

An apparatus of this type known from WO 98/47630 published 29 Oct. 1998 serves for applying dispersions to a web where downstream of the slot nozzle in each edge region of the web there is an element for aspirating the dispersion. Suction nozzles that can be moved vertically and transversely to the web-travel direction are used to aspirate any excess coating on the two web edges. The excess of coating material results from the fact that the curtain is somewhat constricted at its edge guides and thus is applied somewhat more thickly to the web in these regions so as to produce an edge bead. This effect is known as "neck in." The excess at the edges creates unwanted variations in thickness of the coated web and can lead to problems in a subsequent dryer or when rolling up the coated web.

OBJECT OF THE INVENTION

It is an object of the invention to so improve a coating apparatus of the above-described type that, with simplified construction, it is possible to achieve a uniform layer of the coating material over the entire width of the web with straight and sharp coating edges.

SUMMARY OF THE INVENTION

This object is achieved in that an aspiration element is fixed at a lower end of each guide element, has an inner face that is turned toward the curtain and aligned with an inner face of the guide element, and is formed with a throughgoing vacuum line opening into a vacuum passage that opens into an aspiration groove that extends vertically on a lower region of the inner face of the aspiration element in a plane of the curtain.

Such construction of the aspiration element ensures on the one hand a trouble-free exactly guided application of each curtain edge up to immediately before it engages the web and on the other hand aspirates any excess coating at the edges horizontally toward the outside and thus eliminates the so-called "neck-in" effect. A sharp and straight edge is produced on coating the web.

SPECIFIC DESCRIPTION

Figure 1:
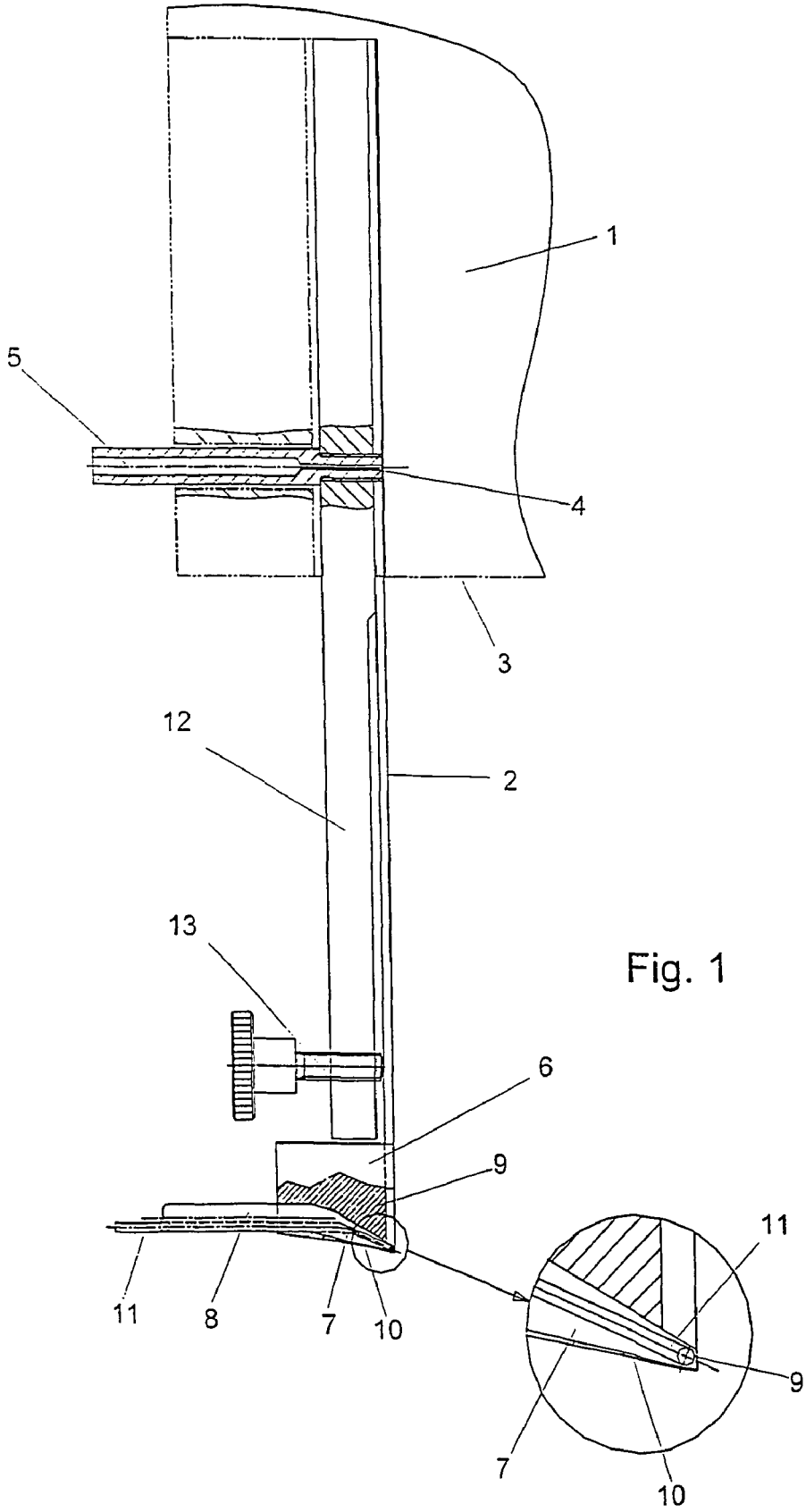
FIG. 1 shows a cross section through a curtain at an edge region of a coating apparatus.

The coating apparatus shown in the drawing serves for applying a dispersion adhesive (e.g. an acrylate) in an aqueous solution to a siliconized paper web. Due to its advantageous characteristics, the apparatus can also be used to apply other dispersions onto paper webs or plastic or metal foils as well as to coat paper or cardboard webs with ink.

The apparatus has a slot nozzle 1 that is suspended in a frame of the apparatus above the path of the web. The slot nozzle 1 is connected to a supply of coating material and has on its underside an outlet slot 3 extending the full coating width and from which the coating material drops as a free-falling curtain that lands on the upper surface of the web.

At each side of the slot nozzle 1 directly against the outlet slot 3 is a bar-shaped guide element 2 that extends downward to immediately adjacent the web. Each guide element 2 has an inner face that is turned toward the curtain and that is coated with a wetting agent, for example with water or the coating material. To this end each guide element 2 has above the outlet slot 3 of the slot nozzle 1 a throughgoing hole 4 that is connected to a feed line 5 via which the wetting agent is supplied. At its inner end the throughgoing hole 4 opens into a feed passage 14 running vertically downward from above the outlet slot 3 and having an output end that is level with and directly adjacent the outlet slot 3. The feed passage 14 is of very simple construction, comprised of a vertical straight groove formed on the outer face of the side wall of the slot nozzle 1 and closed when the guide element 2 is fixed to the side wall.

Preferably each guide element 2 is formed as a bar and has a thickness of 0.1 mm to 0.3 mm and a width of about 10 to 20 mm. The length of the guide element 2 corresponds to the height of the curtain, that is the spacing between the outlet slot and the web being coated. In this embodiment the drop height of the curtain and thus the downwardly extending free portion of each guide element 2 is between 50 mm and 250 mm.

Figure 2:
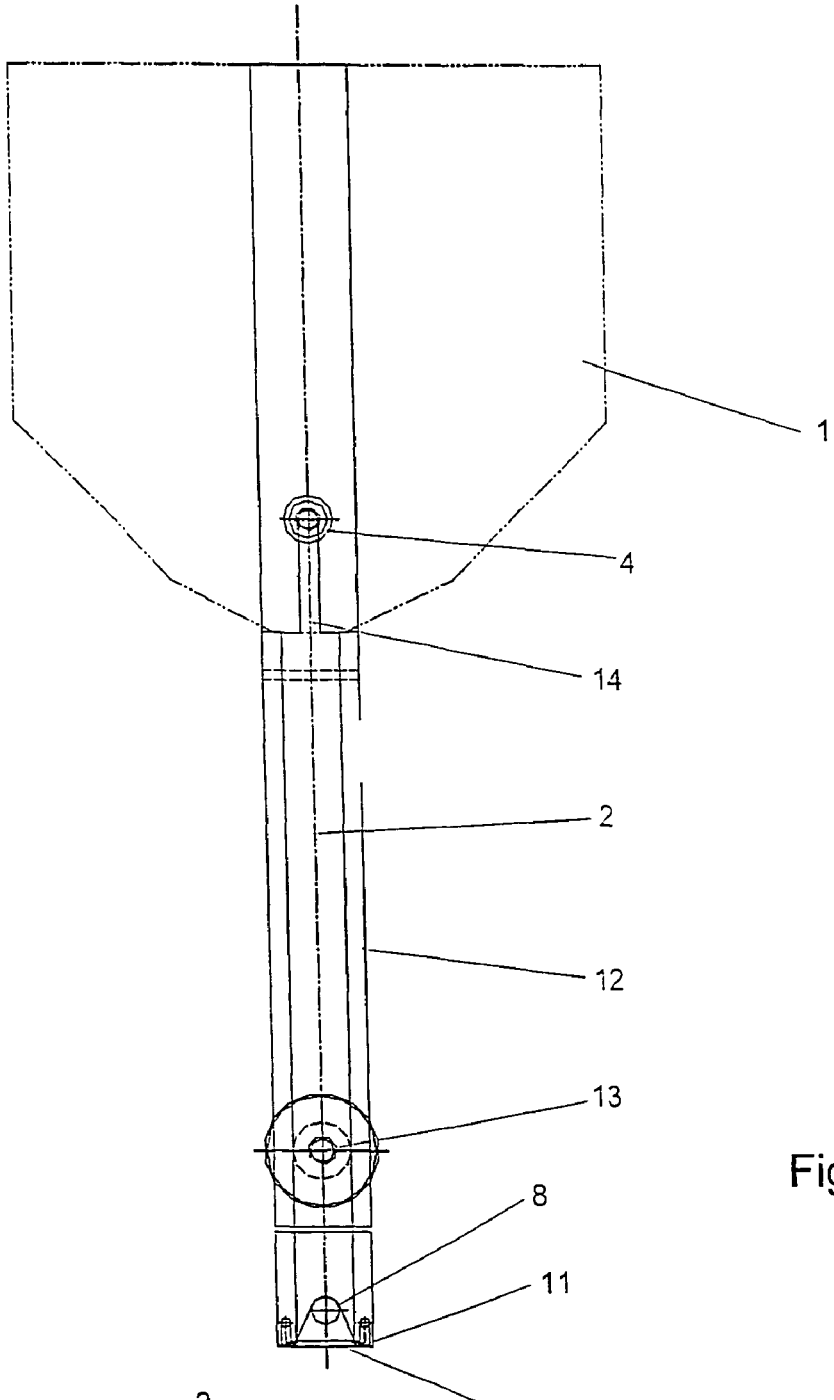
FIG. 2 is a side view of the apparatus of FIG. 1.
Figure 3:
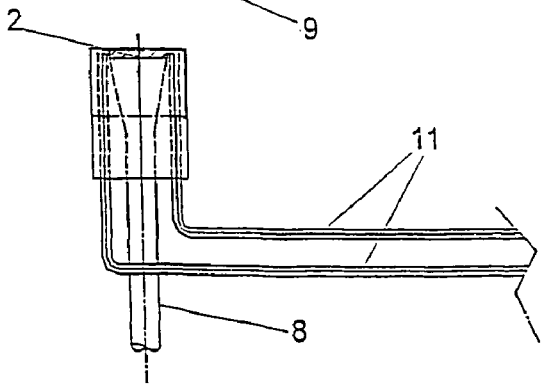
FIG. 3 is a top view on the aspirating element.

It is significant for the invention that each guide element 2 carries at its lower end an aspirating element 6 whose inner face turned toward the curtain is aligned with the inner face of the guide element 2. As a result the curtain edge flowing down the guide element 2 and then onto the aspirating element 6 is not disturbed on its way toward the web. A vacuum passage 7 leads inward through the aspirating element 6 and is connected to a suction line 8. The vacuum passage 7 is at the lower end of the aspirating element 6 and opens into an aspiration groove 9 that extends vertically on the lower end of the inner face of the aspirating element 6. The width parallel to the web-travel direction of the aspiration groove 9 is 0.5 mm to 15 mm, preferably 5 mm to 12 mm, so that aspiration is maintained even when the curtain moves somewhat in a direction transverse to its plane, which here is parallel to the plane of the view in FIG. 2. Its depth is 0.1 mm to 2 mm, preferably 0.5 mm to 1 mm. It is mounted on the lower end of the aspirating element 6 such that its spacing from the web is 0.1 mm to 3 mm. In order to maintain this slight spacing, the vacuum passage 7 ends at a narrow floor 10 inclined slightly toward the web and ending at a sharp edge in the aspiration groove 9. Aspiration of the thick edge of the coating material thus is effected horizontally. This has the advantage that the forces working against such aspiration are minimal and also that the edge is not smeared by the aspiration. Further horizontal orientation without dead zones in the vacuum passage 7 prevents aspirated coating material from forming deposits.

In order to prevent depositions from forming in the aspiration groove 9 and in the vacuum passage 7, a rinse liquid, for example water, is flushed through them. To this end, two rinse passages 11 extend parallel to the suction line 8 and open into the aspiration groove 9 at a slight spacing upstream and downstream relative to the web-travel direction of the vacuum passage 7. The rinse liquid is carried off with the aspirated coating material by the suction line 8. The suction line 8 is to this end connected to the intake of a pump.

To be able to do some adjustment of the position of the edge of the curtain transverse to the web-travel direction, both guide elements 2 are formed of a limitedly flexible and elastically bendable material, for example spring steel. A support beam 12 extends downward from the side wall of the slot nozzle 1 and is closely juxtaposed with each guide element 2 in order to brace and position it. The support beam 12 is made of a rigid material, for example of fairly thick steel, and ends just short of the aspirating element 6. At its lower end the support beam holds an externally operable adjustment element, for example a screw 13, that can press from outside against the guide element 2. The adjustment screw 13 can limitedly move the free end of the guide element 2 with the aspirating element 6 carried on it transversely of the web-travel direction in order to exactly set the position of the aspiration element 9. In addition the adjustment elements 13 also allow the shapes of the guide elements 2 to be adjusted within limits in order to optimize the guiding and maintenance of the curtain edges.

The invention claimed is:

1. A coating system for a web traveling in a web-travel direction, the coating system comprising:

a slot nozzle from which a curtain of a coating material falls on the traveling web;

a pair of guide elements flanking the slot nozzle and having confronting and vertical inner faces engaging and defining edges of the curtain;

respective aspiration elements fixed at lower ends of the guide elements, having inner faces vertically aligned with and forming vertical continuations of the inner faces of the respective guide elements, and each formed with a vertical and inwardly open aspiration groove and with a transversely extending vacuum passage open into the respective groove;

respective floors on the aspiration elements downwardly closing the respective aspiration grooves and each formed with a sharp inwardly directed edge closely spacedly juxtaposed with the web; and means for aspirating excess coating material from the curtain through the vacuum passages.

2. The coating system defined in claim 1 wherein the aspiration groove ends at the sharp edge 0.1 mm to 3 mm from the web.

3. The coating system defined in claim 2 wherein the aspiration groove has a horizontal width parallel to the web-travel direction of 0.5 mm to 15 mm.

4. The coating system defined in claim 2 wherein the aspiration groove has a horizontal depth perpendicular to the web-travel direction of 0.1 mm to 2 mm.

5. The coating system defined in claim 1 wherein each guide element is formed above the respective aspiration element with an inwardly open rinse passage, the system further comprising means for feeding a rinse liquid to the rinse passages.

6. The coating system defined in claim 1 wherein each floor is inclined at a slight acute angle inward and downward toward the web.

7. The coating system defined in claim 1 wherein each guide element is vertically elongated and is elastically bendable in a plane of the curtain.

8. The coating system defined in claim 7, further comprising respective edge-adjustment means bearing radially inward on the guide elements for elastically inwardly deforming same and thereby establishing a curtain width.

* * * * *